US008167680B2

(12) United States Patent
Nauche

(10) Patent No.: US 8,167,680 B2
(45) Date of Patent: May 1, 2012

(54) METHOD AND A DEVICE FOR EDGING AN OPHTHALMIC LENS FOR MACHINING THE EDGE FACE OF THE LENS TO A DESIRED CURVE

(75) Inventor: Michel Nauche, Charenton-le-Pont (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 999 days.

(21) Appl. No.: 12/094,784

(22) PCT Filed: Nov. 23, 2006

(86) PCT No.: PCT/FR2006/002574

§ 371 (c)(1), (2), (4) Date: May 23, 2008

(87) PCT Pub. No.: WO2007/060329

PCT Pub. Date: May 31, 2007

(65) Prior Publication Data

US 2009/0093194 A1 Apr. 9, 2009

(30) Foreign Application Priority Data

Nov. 24, 2005 (FR) ..... 05 11895

(51) Int. Cl.
*B24B 1/00* (2006.01)

(52) U.S. Cl. ..... 451/5; 445/43; 445/277

(58) Field of Classification Search ..... 451/43, 451/5, 248, 277
See application file for complete search history.

(56) References Cited

U.S. PATENT DOCUMENTS 6,478,657 B1 * 11/2002 Shibata ..... 451/5
6,719,609 B2 * 4/2004 Mizuno et al. ..... 451/10
7,476,143 B2 * 1/2009 Shibata ..... 451/5

FOREIGN PATENT DOCUMENTS

EP 1 310 326 A1 5/2003
EP 1 510 290 A1 3/2005

* cited by examiner

*Primary Examiner* — Maurina Rachuba
(74) *Attorney, Agent, or Firm* — Young & Thompson

(57) ABSTRACT

A method and device for edging an ophthalmic lens, includes turning the lens about a first axis of rotation and working on the edge face of the lens with a beveling grindwheel or cutter having a beveling groove or chamfer and mounted to rotate about a second axis of rotation. While machining the edge face of the lens with the beveling grindwheel or cutter, the first and second axis of rotation are moved dynamically relative to each other as a function of the angle of rotation of the lens about the first axis of rotation, in such a manner that during machining of each portion of the edge face of the lens, the tangent to the curve of the working portion of the beveling groove or chamfer is substantially parallel to the tangent to the curve of the bevel desired on the portion of the edge face.

17 Claims, 8 Drawing Sheets

Fig.5
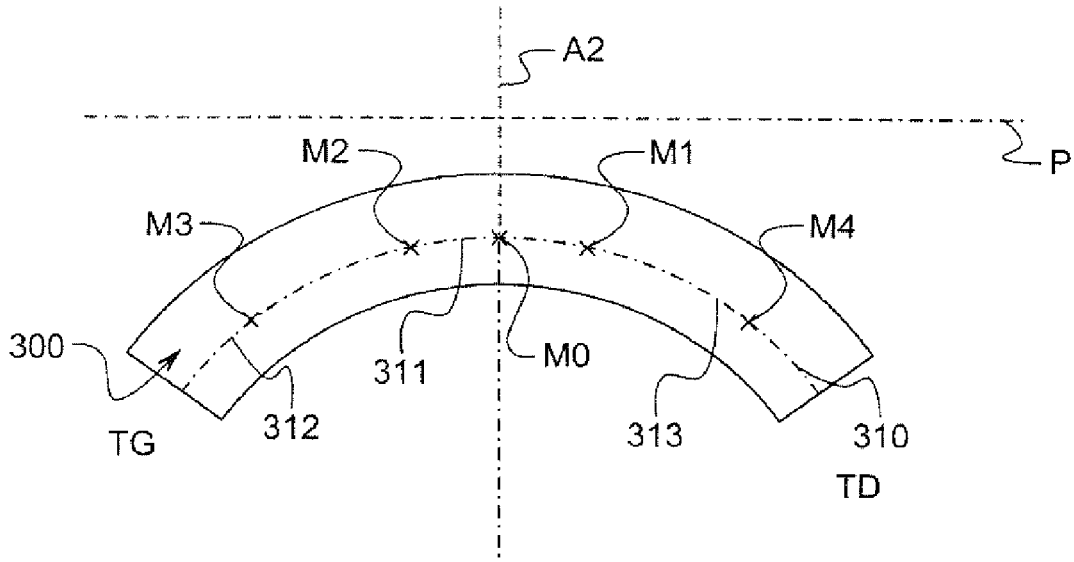
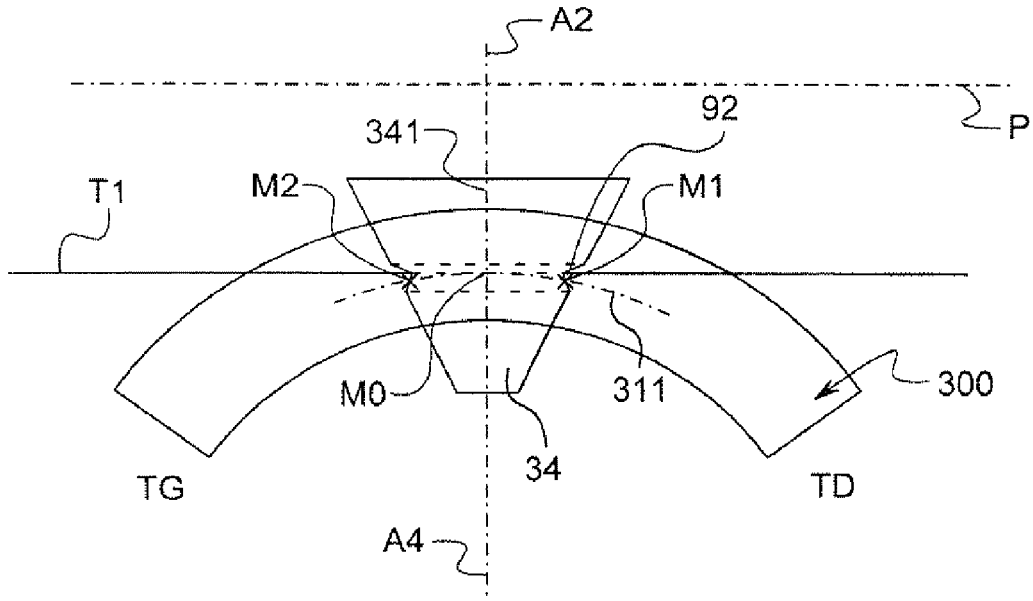
Fig.6

METHOD AND A DEVICE FOR EDGING AN OPHTHALMIC LENS FOR MACHINING THE EDGE FACE OF THE LENS TO A DESIRED CURVE

TECHNICAL FIELD TO WHICH THE INVENTION RELATES

The present invention relates in general to mounting ophthalmic Lenses of a pair of correcting eyeglasses on or in a frame, and it relates more particularly to a method and to a device for edging an ophthalmic lens of a pair of eyeglasses.

A particularly advantageous application of the invention lies in ophthalmic lenses presenting a front face that is strongly cambered.

TECHNOLOGICAL BACKGROUND

A frame conventionally has rims, each presenting an inside bezel forming a groove. Under such circumstances, edging a lens for it to be mounted in the frame selected by the future user consists in modifying the outline of the lens to match it to the selected frame. Edging comprises edging for shaping the periphery of the lens and also for appropriately beveling the edge face of the lens.

Edging consists in removing the superfluous peripheral portion of the ophthalmic lens in question so as to reduce its outline, which is usually initially circular, to the outline desired for the surround of the eyeglass in question. This edging operation is usually followed by a chamfering operation, which consists in rounding or chamfering the two sharp edges of the edged lens.

Chamfering is accompanied or preceded by beveling which consists in forming a rib, commonly referred to a bevel and generally of triangular cross-section, on the edge Lace of the ophthalmic lens. The bevel is for engaging in the bezel formed in the surround of the eyeglasses frame in which the lens is to be mounted.

Conventionally, such edger means are constituted by a machine tool, referred to as a grinder, that possesses a main grindwheel set and means for blocking and rotating the lens, said means being constituted by two rotary shafts on a common axis and mounted to move axially relative to each other in order to clamp the lens on its axis with a pinching movement. To enable the lens to move towards or away from the grindwheel during machining, the clamping and drive shafts are carried on a rocker that is movable (in pivoting or translation) transversely relative to the shaft.

Usually, the operations of edging, chamfering, and beveling are performed successively on the same grinder, which is fitted with a suitable set of grindwheels.

At present, it is known that the periphery of an ophthalmic lens can be edged in two steps. A roughing step is performed initially, in which the periphery of the lens is roughed out on a cylindrical roughing grindwheel forming one of the set of grindwheels. During this roughing, the lens is roughed out so as to come close to the shape that is it desired to give to the lens. Thereafter, a finishing step is performed on the periphery of the lens, using a cylindrical finishing grindwheel that is also present in the set of grindwheels, having the same diameter and the same axis as the roughing grindwheel, but possessing grains of a finer size than the grains used in the roughing grindwheel. During this finishing step, less material is removed from the periphery of the lens, and the desired shape is reached with accuracy better than the accuracy that can be obtained with a roughing grindwheel. The finishing grindwheel presents a beveling groove in its edging face so beveling is performed during the finishing step.

Nevertheless, with lenses that are strongly cambered, it is found that a phenomenon occurs whereby the bevel on the strongly cambered portions of the edge face of the lens becomes thinned. This bevel-thinning phenomenon degrades the quality and the precision with which the lens can be mounted in its frame.

OBJECT OF THE INVENTION

The present invention proposes a novel method and a novel device making it possible to limit the extent to which the bevel is pared away while making a bevel on the edge face of a lens.

To this end, the invention provides a method of edging an ophthalmic lens comprising turning the lens about a first axis of rotation and working on the edge face of the lens by means of a beveling grindwheel or cutter provided with a beveling groove or chamfer and mounted to rotate about a second axis of rotation, in which, while machining the edge face of the lens with the beveling grindwheel or cutter, the second axis of rotation and the first axis of rotation are moved dynamically relative to each other as a function of the angle of rotation of the lens about said first axis of rotation, in such a manner that during machining of each portion of the edge face of the lens, the tangent to the curve of the working portion of the beveling groove or chamfer is substantially parallel to the tangent to the curve of the bevel desired on said portion of the edge face.

The invention also provides an shaper device for edging an ophthalmic lens, the device comprising a support for the lens mounted to turn about a first axis of rotation, and a beveling grindwheel or cutter for working the edge face of the lens and mounted to turn about a second axis of rotation, in which said second axis of rotation possesses a controlled freedom of movement, and in which said device includes a control unit programmed to control said movement in accordance with such an edging method.

It will be understood that the arc of the finishing wheel that is engaged with the material at the periphery of the lens is extensive. When the bevel to be made presents strong camber in the plane of the edge face of the lens, it is then observed that the beveling groove of the finishing wheel interferes with the portion of the bevel that had already been made.

By means of the invention, the controlled movement of the axis of rotation of the beveling grindwheel or cutter relative to the axis of rotation of the lens as a function of the angle of rotation of the lens makes it possible to provide a bevel on the edge face of the lens that follows a desired curve, with this being achieved by controlling the direction of the tangent to the curve of the bevel that is to be made at each point along the edge face. In particular, the working portion of the beveling groove or chamfer extends around the bevel to be made. The bevel as made in this way on the edge face of the lens substantially retains its nominal size, i.e. a positive reproduction of the depth and the width of the beveling groove. Such a bevel that has not been pared away can be referred to as a "full-scale bevel".

According to a first advantageous characteristic of the invention, the second axis of rotation is inclined relative to the first axis of rotation by a non-zero angle. Preferably, the angle formed between the first and second axes of rotation is about ten degrees.

By means of the non-zero angle formed between the axis of rotation of the grinding tool and the axis of rotation of the lens, it is possible by varying the position of the axis of rotation of the grinding tool to vary the orientation of the working portion of the grinding tool relative to the edge face of the lens to be machined.

In an implementation of the invention, the movement of the second axis of rotation is obtained by freedom of movement in translation in the plane extending transversely to the first axis of rotation. Preferably, the axis of rotation of the lens possesses freedom to move in a reproduction direction that extends substantially transversely to its axis of rotation, and the direction of movement of the second axis of rotation of the beveling grindwheel or cutter extends transversely to said reproduction direction.

In a second implementation of the invention, the movement of the second axis of rotation is obtained by a first freedom of movement in pivoting about a first pivot axis parallel to the second axis of rotation.

In a third implementation of the invention, the movement of the second axis of rotation is obtained by a second freedom to move in pivoting about a retraction axis parallel to the first axis of rotation.

The retraction axis of the tool is initial provided for moving the working tool up to the edge face of the lens in order to machine it. Advantageously, during pivoting of the axis of rotation of the tool about the retraction axis, and because of the non-zero angle formed between the axis of rotation of the finishing wheel and the retraction axis, the position of the axis of rotation and thus of the working portion of the grinding tool varies relative to the edge face of the lens to be machined. It is thus possible to cause the position of the axis of rotation of the tool to vary by making use of the first freedom of movement in pivoting of the tool that already exists, thus making it possible to avoid adding additional motor control that would be expensive and bulky.

In a fourth implementation of the invention, the movement of the axis of rotation is obtained by a third freedom of movement about a second pivot axis situated in a plane extending transversely to the first axis of rotation and substantially normal to the plane that is tangential to the portion of the edge face that is being machined.

This additional pivot axis makes it possible to obtain a wide range of orientations for the axis of rotation of the working tool relative to the axis of rotation of the lens. It also makes it possible to orient the axis of rotation of the working tool independently of its position relative to the lens, thus making it possible to improve the accuracy with which the edge face of the lens is machined.

According to another advantageous characteristic of the invention, the edging grindwheel or cutter possesses a maximum diameter of no more than 35 millimeters (mm), preferably 25 mm.

A small diameter makes it possible to remove little material at any one time, and thus to reduce the Interference between the working portion of the beveling groove and the bevel portion that has already been made.

According to another advantageous characteristic of the invention, the beveling grindwheel or cutter presents a conical edging face in addition to the beveling groove or chamfer. Preferably, the cone angle of the edging face of the beveling grindwheel or cutter is substantially equal to the angle formed between the second axis of rotation and the first axis of rotation.

Because of the evolute of its beveling groove working on the edge face of the lens, the conical beveling grindwheel or cutter having its axis of rotation inclined relative to the axis of rotation of the lens forms a bevel portion that possesses a certain amount of curvature in the plane of the edge face of the lens. This curvature makes it possible to extend around the bevel portion while it is being made, thereby reducing interference between the working portion of the beveling groove and the portion of the bevel that has already been made. This limits the extent to which the bevel is pared away.

According to another advantageous characteristic of the invention, the step of working the edge face of the lens with the beveling grindwheel or cutter is an edging finishing step, and provision is made prior to the edging finishing step for a step of roughing out the edging the edge face of the lens by means of an edging roughing-out grindwheel mounted to rotate about a third axis of rotation parallel to the first axis.

The step of roughing out the edging of the edge face of the lens with the edging roughing grindwheel makes it possible to shorten machining time by roughing out the periphery of the lens. The accuracy with which the edge face of the lens is machined is then achieved during the finishing step using an edging finishing wheel and/or the working tool.

DETAILED DESCRIPTION OF AN EMBODIMENT

The following description with reference to the accompanying drawings of an embodiment, given by way of non-limiting example, makes it clear what the invention consists on and how it can be performed.

In the accompanying drawings:

FIG. 5 is a diagrammatic plan view of the lens with a plurality of points in the bottom portion of the edge face of the lens to be machined;

FIG. 6 is a diagrammatic plan view of the lens with the finishing grindwheel while machining in the plane tangential to the edge face of the lens at a first machining point;

FIG. 1 shows a shaper device 10 for implementing a method of working the periphery of an ophthalmic lens 31 for eyeglasses.

The shaper device 10 of the invention may be implemented in the form of any machine for cutting or removing material suitable for modifying the outline of the ophthalmic lens 31 in order to fit it to the rim of a selected frame. By way of example, such a machine may consist in a grinder as in the above-described example, but it could equally well be a machine for milling or cutting by laser or by water jet, etc.

Figure 1:
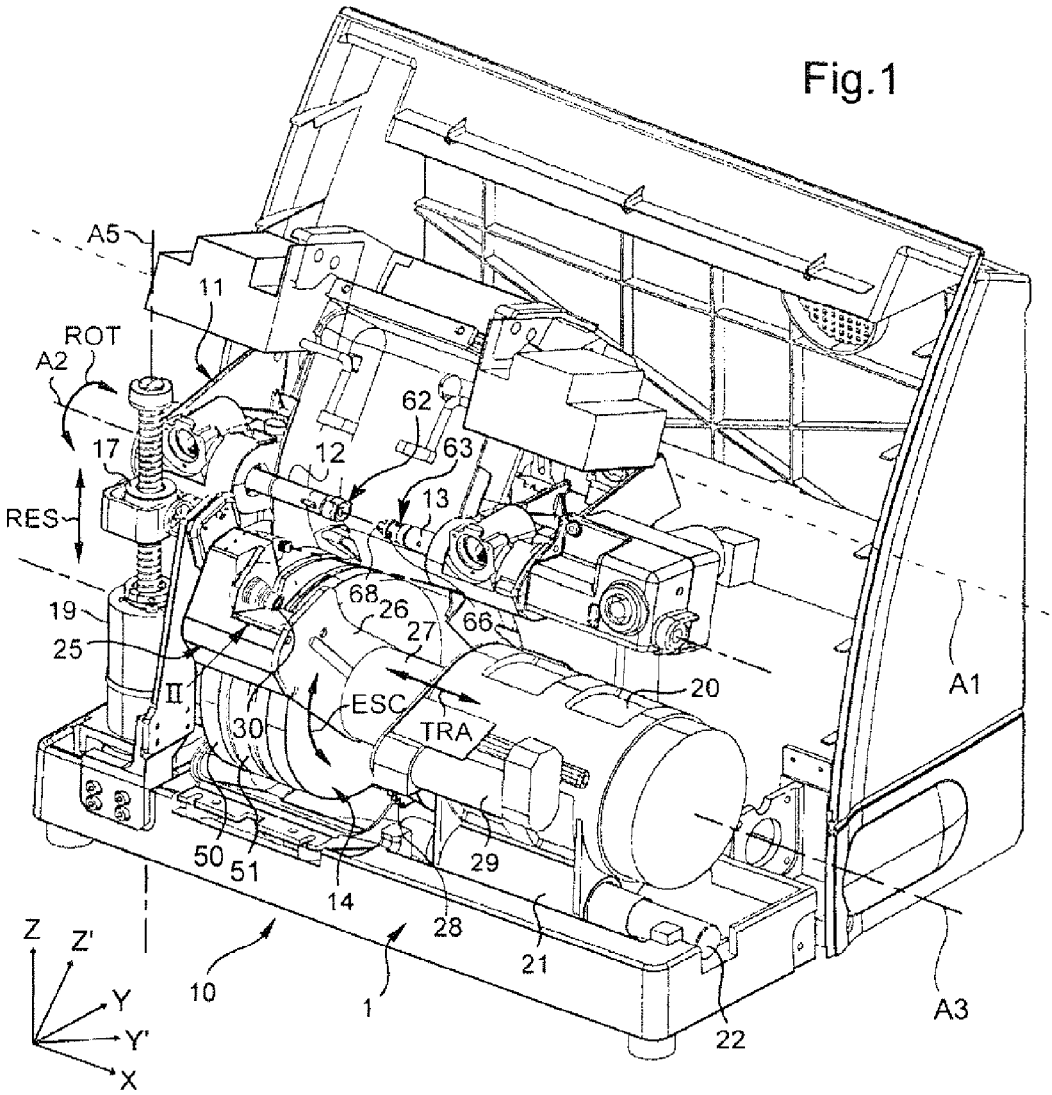
FIG. 1 is a general diagrammatic perspective view of a shaper device fitted with a working tool for working the periphery of an ophthalmic lens.

In the example shown diagrammatically in FIG. 1, the shaper device 10 comprises in conventional manner, an automatic cutter that is commonly said to be "numerically controlled". Specifically, this cutter comprises a rocker 11 that is mounted to pivot freely relative to a structure 1 about an axis A1, in practice a horizontal axis.

To hold an ophthalmic lens 31 for machining stationary and to drive it in rotation, the cutter is fitted with two clamping and rotary-drive shafts 12, 13. These two shafts are in mutual alignment on an axis A2, referred to as the "blocking" axis, parallel to the axis A1. The two shafts 12, 13 are driven to rotate synchronously by a motor (not shown), via a common drive mechanism (not shown), incorporated in the rocker 11. This common synchronous rotary drive is of conventional type and is known in itself.

In a variant, provision could also be made to drive the two shafts by two distinct motors that are synchronized mechanically or electronically.

The rotation ROT of the shafts 12, 13 is controlled by a central electronic and computer system (not shown) such as an integrated microcomputer or a set of dedicated integrated circuits.

Each of the shafts 12, 13 possesses a free end that faces the free end of the other shaft and that is fitted with a blocking chuck 62, 63. Both locking chucks 62, 63 are generally bodies of revolution about the axis A2, and each presents an application face (not shown) extending generally transversely and arranged to bear against the corresponding face of the ophthalmic lens 31.

In the example shown, the chuck 62 is a single piece and is fastened without any degree of freedom in sliding or in rotation on the free end of the shaft 12. In contrast, the chuck 63 comprises two portions: an application pellet 66 for co-operating with the lens 31 and for this purpose carrying a working face (not shown) and a shank (not shown) arranged to co-operate with the free end of the shaft 13, as described in greater detail below. The pellet 66 is attached to the shank by a cardan connection 68 serving to transmit rotation about the axis A2, while allowing variation in the orientation of the pellet 66 about any axis perpendicular to the axis A2. The working faces (not shown) of the chucks are preferably covered in respective thin coverings of plastics material or of elastomer material. The thickness of the covering is about 1 mm to 2 mm. By way of example, it may be made of a flexible polyvinylchloride (PVC) or by a neoprene.

The shaft 13 is movable in translation along the blocking axis A2, facing the other shaft 12 in order to clamp the lens 31 in axial compression between the two blocking chucks 62, 63. The shaft 13 is controlled to move in axial translation by a drive motor via an actuator mechanism (not shown), itself under the control of the central electronic and computer system. The other shaft 12 is stationary in translation along the blocking axis A2.

The device 10 includes a set 14 of main grindwheels mounted on a third axis A3 for roughing out and finishing the edging of the ophthalmic lens 31 for machining.

The main grindwheel set 14 is fitted on a common shaft of axis A3 for driving the grindwheels in rotation during the edging operation. This common shaft, which is not visible in the figures, is rotated by an electric motor 20 controlled by the electronic and computer system.

The main grindwheel set 14 is also movable in translation along the axis A3 and this movement in translation is driven under the control of a motor. Specifically, the entire main grindwheel set 14 including its shaft and its motor is carried by a carriage 21 that is itself mounted on slides 22 secured to the structure 1 so as to be able to slide along the third axis A3. The movement in translation of the grindwheel-carrier carriage 21 is referred to as "transfer" and is abbreviated TRA. This transfer is controlled by a motorized drive mechanism (not shown), such as a rack or a screw-and-nut system, controlled by the central electronic and computer system.

To enable the spacing between the axis A3 of the grindwheel 14 and the axis A2 of the lens 31 to be adjusted dynamically during edging, use is made of the ability of the rocker 11 to pivot about the axis A1. This pivoting gives rise to an effect of the lens 31 clamped between the shafts 12 and 13 moving substantially vertically, thereby moving the lens 31 towards or away from the grindwheel 14. This ability to mover that serves to reproduce the desired edging shape as programmed in the electronic and computer system is referred to as "reproduction" and is referenced RES in the figures. This reproduction movement RES is controlled by the central electronic and computer system.

Figure 3:
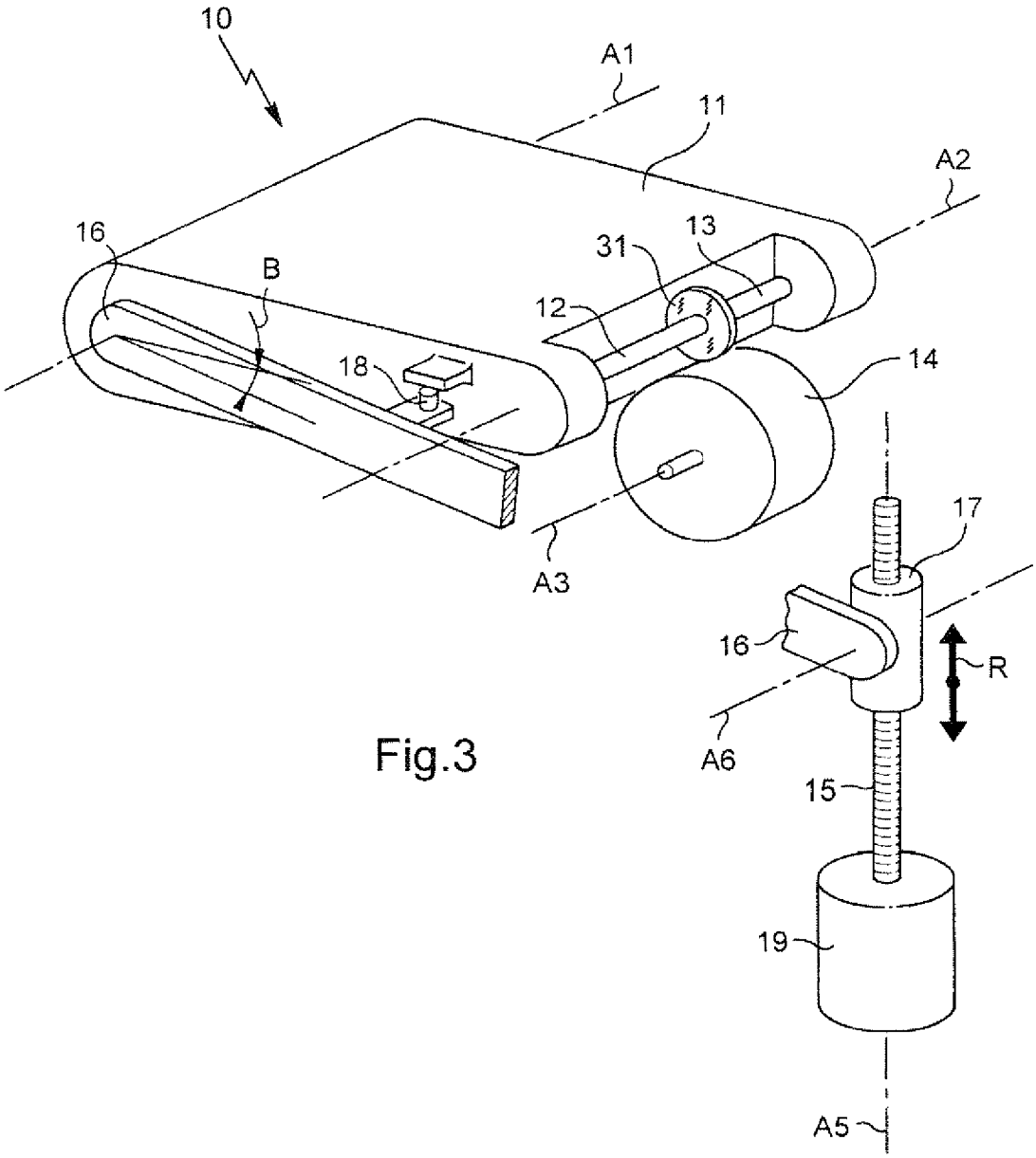
FIG. 3 is a diagrammatic perspective view of a grinder with its rocker device.

In the example shown diagrammatically in FIG. 3, the grinder 10 implements this reproduction by means of a link 16 that is hinged at one of its ends to the structure 1 about the same first axis A1 as the rocker 11, and that is hinged at its other end about an axis AC that is parallel to the first axis A1 to a nut 17 that is mounted to move along a fifth axis A5, commonly referred to as the reproduction axis, perpendicular to the first axis A1, there being a contact sensor 18 interposed between the link 16 and the rocker 11. By way of example, the contact sensor 18 is constituted by a Hall cell sensor or merely by an electrical contact.

As shown diagrammatically in FIG. 3, the nut 17 is tapped and in screw engagement with a threaded rod 15 in alignment on the fifth axis A5 and driven in rotation by a reproduction motor 19. The motor 19 is controlled by the central electronic and computer system. Reference B designates the angle through which the rocker 11 is pivoted about the axis A1 relative to the horizontal. This angle B is associated with the vertical translation movement referenced R of the nut 17 along the axis A5. When the ophthalmic lens 31 for machining, suitably clamped between the two shafts 12 and 13, is brought into contact with the grindwheel 14, material is removed therefrom until the rocker 11 comes into abutment against the link 16 by pressing thereagainst via the contact sensor 18, with said sensor duly sensing the contact.

In a variant, as shown in FIG. 1, provision is made for the rocker 11 to be hinged directly to the nut 17 that is mounted to move along the reproduction axis A5. A strain gauge is associated with the rocker to measure the machining advance force applied to the lens. During machining, this provides continuous measurement of the grinding advance force that is applied to the lens, and the advance of the nut 17, and thus of the lens 11, is controlled so as to ensure that this force remains below some maximum setpoint value. For each lens, the setpoint value is adapted to the material and the shape of the lens.

In any event, in order to machine the ophthalmic lens 31 to have a given outline, it thus suffices firstly to move the nut 17 accordingly along the fifth axis A5 under the control of the motor 19 so as to control the reproduction movement, and secondly to cause the support shaft 12, 13 to pivot together about the second axis A2, in practice under the control of the motor controlling them. The transverse reproduction movement RES of the rocker 11 and the rotary movement ROT of the lens shafts 12 and 13 are controlled in coordinated manner by the electronic and computer system (not shown) that is appropriately programmed for this purpose so that all of the points on the outline of the ophthalmic lens 31 are brought in succession to the appropriate diameter.

The grinder also includes a finishing module 25 that is movable with one degree of freedom along a direction that is substantially transverse relative to the axis A2 of the shafts 1L2, 13 for holding the lens 31 and to the axis A5 for reproduction RES. This degree of freedom is referred to as retraction and is referenced ESC on the figures.

Specifically, this retraction consists in pivoting the finishing module 25 about the axis A3. The module 25 is carried by a lever 26 secured to a tubular sleeve 27 mounted on the carriage 21 to pivot about the axis A3. In order to control its pivoting, the sleeve 27 is provided at its end opposite from the lever 26 with a toothed wheel 28 that meshes with a gearwheel (not visible in the figure) fitted to the shaft of an electric motor 29 secured to the carriage 21.

To summarize, it can be seen that the degrees of freedom in movement available on such a shaping grinder are the following:

- rotation of the lens 31 that enables the lens 31 to be turned about its holding axis, which is substantially normal to the general plane of the lens 31;
- reproduction that consists in ability to move the lens 31 transversely (i.e. in the general plane of the lens 31) relative to the working grindwheels, enabling the various radii that describe the outline of the shape desired for the lens 31 to be reproduced;
- transfer that consists in the lens 31 moving axially (i.e. perpendicularly to the general plane of the lens 31) relative to the main set of grindwheels 14, enabling the selected edging grindwheel to be positioned facing the lens 31, and serving during machining to follow the trajectory of the bevel, of the groove, or of the chamfer; and
- retraction, that consists in the finishing module 25 moving transversely relative to the lens 31 in a direction distinct from the reproduction direction, enabling the finishing module 25 to be put into its working position and into its storage position.

As shown diagrammatically in FIG. 1, the main grindwheel set 14 comprises cylindrical grindwheels all having a diameter of about 155 mm. The main grindwheel set 14 comprises a roughing grindwheel 50 having an edging face that constitutes a surface of revolution about its axis of rotation A3. The grains in the edging face of the roughing grindwheel have a size of about 150 micrometers (μm).

Beside the roughing grindwheel 50, there is provided a finishing grindwheel 51 that includes a beveling groove. The grains of the finishing grindwheel 51 have a size of about 55 μm.

The finishing module 25 of the shaper device 10 includes a working tool 30 for working the periphery of the ophthalmic lens 31. The tool 30 includes a support 38 incorporating a drive shaft 37 for rotation about an axis A4. This tool 30 is mounted on the finishing module 25 of the shaper device 10 and thus, like the finishing module 25, it possesses freedom to move in retraction ESC by pivoting about the retraction axis A3. The working tool 30 is driven in rotation about its axis of rotation A4 by a motor (not shown). The axis A4 of the working tool 30, mounted on the finishing module 25 is coplanar with the axis A3 and relative to the axis A3 deforms an angle K of about ten degrees (see FIG. 4).

The axis A3 is parallel to the axis A2 and thus the axis A4 forms the angle K of about ten degrees with the axis A2.

Figure 2:
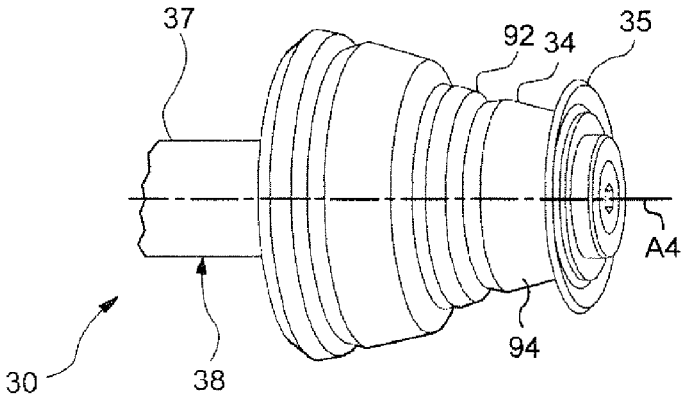
FIG. 2 shows on a larger scale and from a different angle, a detail referenced II in FIG. 1, showing the tool for working the periphery of an ophthalmic lens with a finishing grindwheel and a grooving disk for grooving the periphery of the lens.

The working tool 30 comprises a small finishing grindwheel, referred to as a finishing wheel 34 on the axis A4 (see FIG. 2) and possessing a diameter that is smaller than the diameters of the roughing and finishing grindwheels 50 and 51 of the set 14 of grindwheels. The finishing wheel 34 preferably has a diameter of 18 mm.

The finishing wheel 34 has an edging face 94 constituting a surface of revolution about the axis A4, and a beveling groove 92. The edging face 94 has diamond grains of characteristics that are substantially the same as those of the grains of the finishing grindwheel 51.

The working tool 30 also has a third grindwheel or disk that is 18.8 mm in diameter and that is referred to as a grooving wheel or disk 35.

The finishing wheel 34 has a conical edging face 94 that extends on either side of the beveling groove 92. more precisely, its cone angle corresponds to substantially to the angle of inclination K of the axis of rotation A4 of the tool 30 relative to the retraction axis A3.

Finally, a control unit (not shown) is provided that is programmed to control the position of the axis of rotation A4 of the tool 30 relative to the axis of rotation A2 of the lens 31 as a function of the angle of rotation B of the lens about said axis of rotation A2 of the lens.

Figure 4:
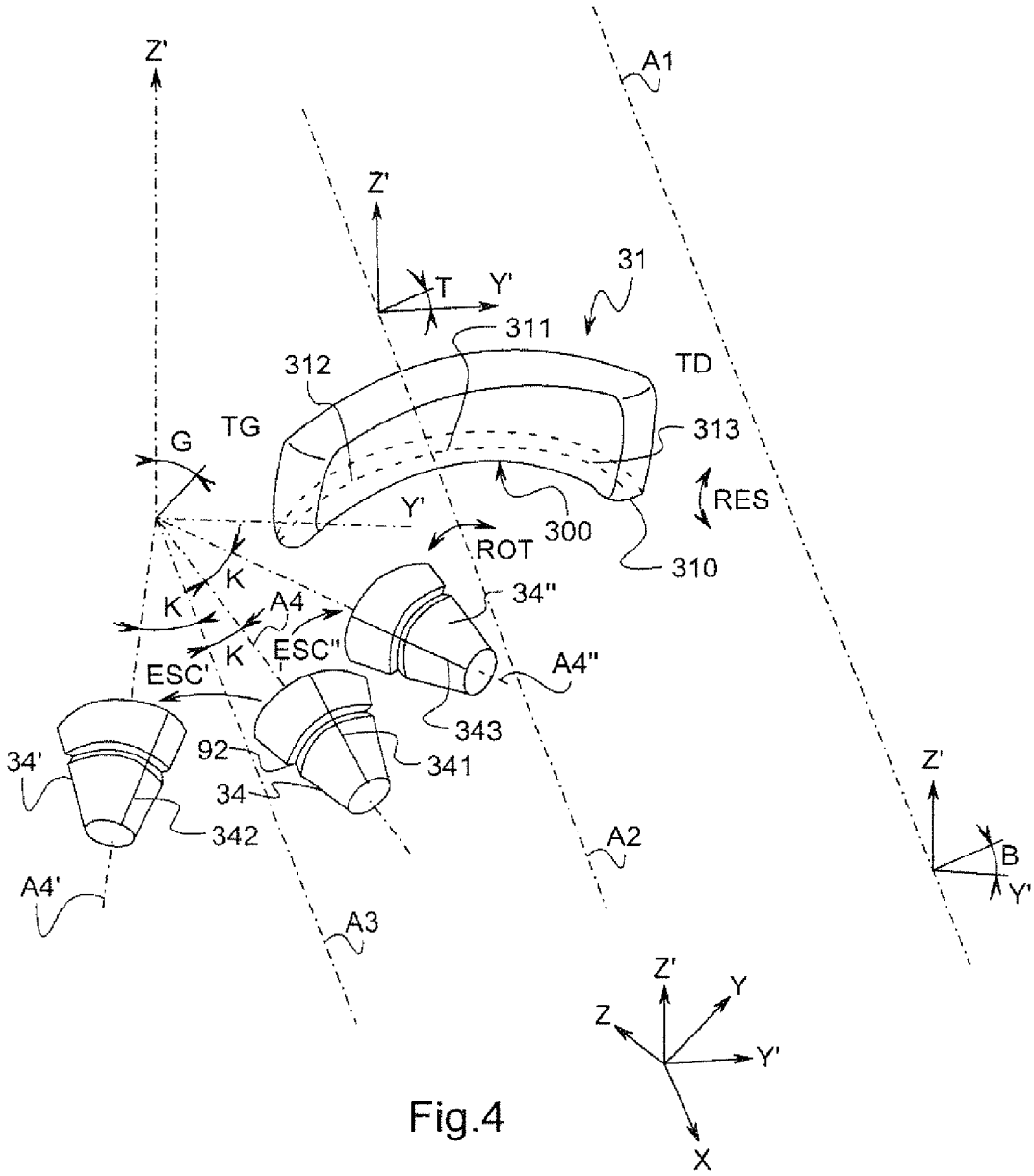
FIG. 4 is a diagrammatic perspective view of the finishing grindwheel and of the lens with three different orientations of the axis of rotation of the finishing grindwheel relative to the axis of rotation of the lens.

The travel direction of the axis A4 is mainly transverse to the axis of rotation A2 of the lens 31 and to the vertical direction Z' of reproduction, i.e. it is substantially along Y' (FIG. 4). The axis A4 is moved in this embodiment by controlling the retraction movement of the axis A4 in pivoting about the retraction axis A3. This freedom to move in retraction of the axis A4 enables the orientation of the plane containing the axes A3 and A4 to be controlled relative to the axis of rotation A2 of the lens 31.

The above-described shaper device is suitable for implementing a method of edging the ophthalmic lens 31.

Initially, a roughing step is performed in which the edge face 300 of the lens 31 is edged by means of the roughing grindwheel 50 of the main grindwheel set 14. During this roughing step, the edge face 300 of the lens 31 is machined flat without a bevel. In a variant, instead of the roughing grindwheel 50, provision can be made to use a roughing grindwheel that includes a beveling groove so as to rough out a bevel on the edge face of the lens during the step of roughing out the edging.

Thereafter, a step of finishing the edging of the edge face of the lens 31 is performed. Given the shape of the bevel that is to be made, an electronic processor unit (not shown) calculates the interference between the bevel that is to be made and the beveling groove of the finishing grindwheel 51. If this interference is too great, i.e. if the bevel is pared away beyond a determined threshold, the electronic processor unit warns the user and recommends using the small finishing wheel 34 for performing the finishing step. Otherwise, the finishing step is performed with the finishing grindwheel 51 of the main grindwheel set 14.

In a variant, the interference between the portion of the bevel to be made and the beveling groove of the finishing grindwheel can be assessed by the operator.

When the finishing step requires the finishing wheel 34 to be used, the control unit controls the finishing wheel 34. Provision can be made for the unit that controls the finishing wheel 34 to be the same as the electronic processor unit. The axis of rotation A4 of the finishing wheel 34 is then moved and oriented relative to the axis of rotation A2 of the lens as a function of the angle of rotation T of the glens 31 about the axis of rotation A2.

In FIGS. 4, 5, 6, 7, and 8, the dimensions of the lens are not in proportion, in particular the width of the edge face 300 of the lens 31 is exaggerated to show up the phenomena that are involved while it is being machined.

The curve of the bevel or of the beveling groove is defined by the mean line or the peak link of said bevel or of said beveling groove.

When the edging face 94 of the finishing wheel 34 provided with the beveling groove 92 is machining the edge face 300 of the lens 31, the working generator line of the finishing wheel 34 is defined as being the generator line of the finishing wheel 34 that is in contact with the edge face 300 of the lens 31. In this embodiment, the working generator line includes a broken-line portion that is V-shaped and that corresponds to the beveling groove. Similarly, the working portion of the beveling groove is defined as being the portion of the beveling groove that penetrates into the edge face of the lens.

In practice, movement of the shaft 37 of axis A4 on which the finishing wheel 34 is mounted is controlled by making use of the retraction and transfer degrees of freedom ESC and TRA of the shaft 37, together with movements in the reproduction and rotation degrees of freedom RES and ROT of the lens 31, such that, for each portion of the edge face of the lens that is being machined, the tangent to the curve of the working portion of the beveling groove 92 of the finishing wheel 34 is substantially parallel to the tangent of the curve of the bevel desired on said portion of the edge face 300.

In FIG. 4, there can be seen three different positions 34, 34', and 34" of the finishing wheel 34 specified in a local frame of reference XY'Z' and corresponding to three different retraction positions that are adapted to the orientation of the curve of the bevel to be made on the bottom portion 310 of the edge face 300 of the lens to be machined. Naturally, the edging method also applies to the side and top portions of the edge face of the lens. The local frame of reference XY'Z' is a result of rotating the frame of reference XYZ about the axis X in such a manner that when the finishing wheel 34 is retracted in a configuration in which its working generator line 341, its axis A3, and the axis A2 are parallel and coplanar, then the axis Z' lies in the plane containing said generator line 341 and both axes A2 and A3.

FIG. 5 shows the curve of a bevel to be made that has three main portions on the bottom portion 310 on the edge face 300 of the lens 31: a central portion 311; a portion 312 situated on the left temple side TG when the eyeglasses are being worn; and a portion 313 situated on the right temple side TD, likewise on being worn. The portions of the edge face of the lens that are situated close to the left temple side TG and to the right temple side TD are cambered, whereas the central portion of the edge face is substantially straight (with little camber). The plane P is defined as being the plane extending transversely to the axis of rotation A2 of the lens 31.

The description below relates to machining certain points of these portions 311, 312, 313 using the edging method of the invention. Naturally, the edge face 300 of the lens is machined continuously by dynamically controlling the position of the lens 31 and the position of the finishing wheel 34 relative to each other.

FIG. 6 shows the arrangement of the finishing wheel 34 relative to the lens L for making the central portion 311 of the bevel on the bottom portion 310 of the edge face 300. The tangent T1 to the curve of the central portion 311 at the point M0 is substantially parallel to the plane P. To machine the central portion 311 at the point M0, the shaft 37 of axis A4 of the finishing wheel 34 is retracted so that the working generator line 341 (see FIG. 4) of the finishing wheel 34 facing the edge face 300 of the lens 31 is parallel to the axis of rotation A2 of the lens 31. In other words, the tangent to the working portion of the beveling groove 92 is substantially parallel to the plane P. Thus, at the point M0, the tangent to the curve of the resulting bevel portion coincides substantially with the tangent T1 to the curve that is desired for the central portion 311 at this point M0.

When the working portion of the beveling groove penetrates into the lens, said working portion extends around the bevel that is to be made with a certain curvature that is determined by the cone angle of the finishing wheel 34, the diameter of the finishing wheel 34, and the angle K formed by the axis of rotation A4 and the retraction axis A1 of the edge face to be machined. A bevel portion is thus obtained that is defined by an arc M1M0M2 that fits the curve desired for the bevel at these points of the edge face.

This arc M1M0M2 results from the fact that the points M2 and M1 of the central portion 311 are in contact with the beveling groove of the conical finishing wheel 34 along a working generator line that is no longer parallel to the axis of rotation A4 of the lens.

Figure 7:
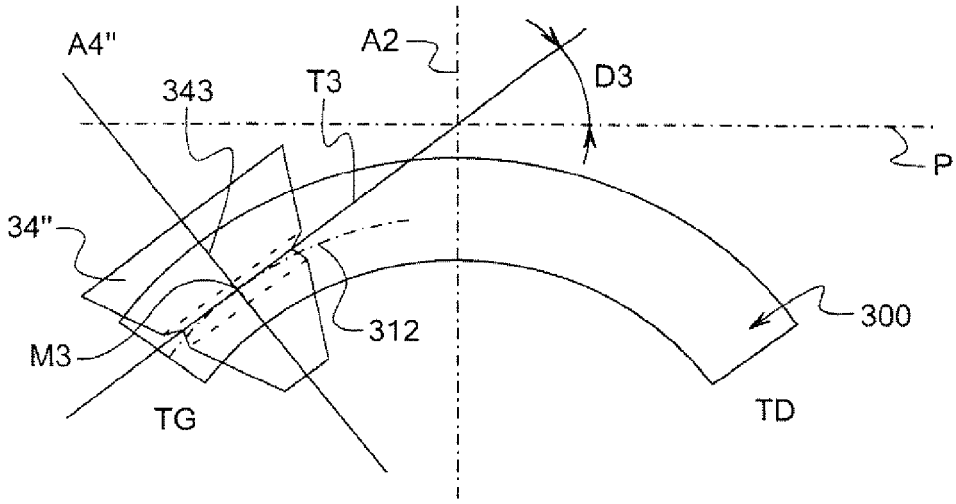
FIG. 7 is a diagrammatic plan view of the lens with the finishing grindwheel while machining in the plane tangential to the edge face of the lens in a second machining point.

As shown in FIG. 7, the tangent T3 at the point M3 to the curve of the portion 312 of the bevel to be formed makes an angle D3 relative to the plane P. As a result of a first retraction movement ESC" of the finishing wheel 34 towards its position referenced 34" in FIG. 4, the axis of rotation A4 of the finishing wheel is transformed into an axis of rotation A4" having a different orientation that enables a working generator line 343 to be used. The lens 31 is caused to approach the finishing wheel by using its freedom of movement in reproduction RES by pivoting though an angle B about the tilt axis A1. The portion 313 of the edge face of the lens 31 for machining is then positioned facing the working generator line 343 by turning the lens 31 through an angle T about its axis of rotation A2. This working generator line 343 situated facing the edge face that is to be machined forms an angle with the axis of rotation A2 of the lens that is greater than that formed by the working generator line that was used for machining the portion 311 at the point M2 (or M1). The angle formed by this working generator line 343 relative to the axis of rotation A2 makes it possible to obtain a bevel portion of tangent to the curve at the point M3 that is inclined substantially at the angle D3 relative to the plane P, as desired. As before, the working portion of the beveling groove extends around the bevel to be made with a certain amount of curvature that matches the curve desired for said portion 312 of the bevel.

Figure 8:
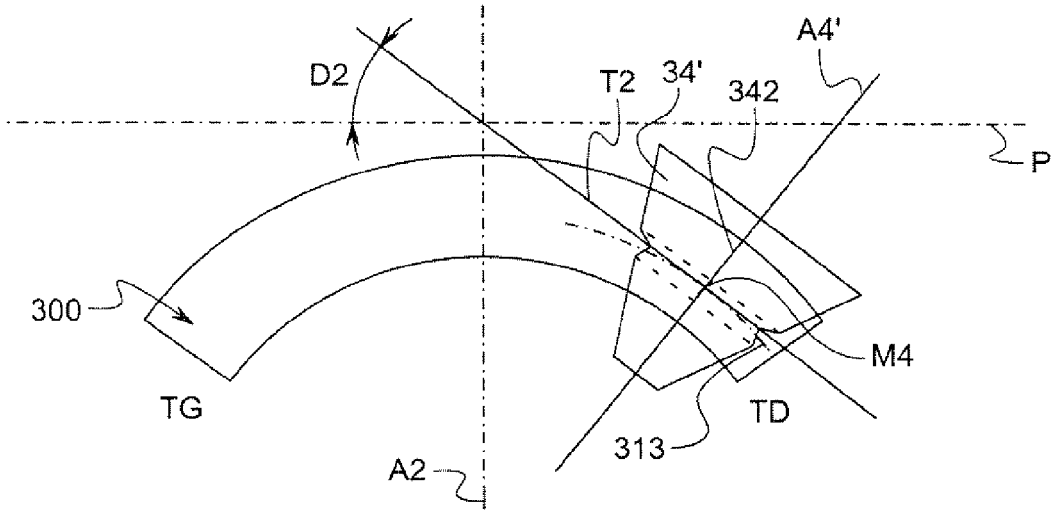
FIG. 8 is a diagrammatic plan view of the lens with the finishing grindwheel while machining in the tangential plane to the edge face of the lens in a third machining point.
Figure 10:
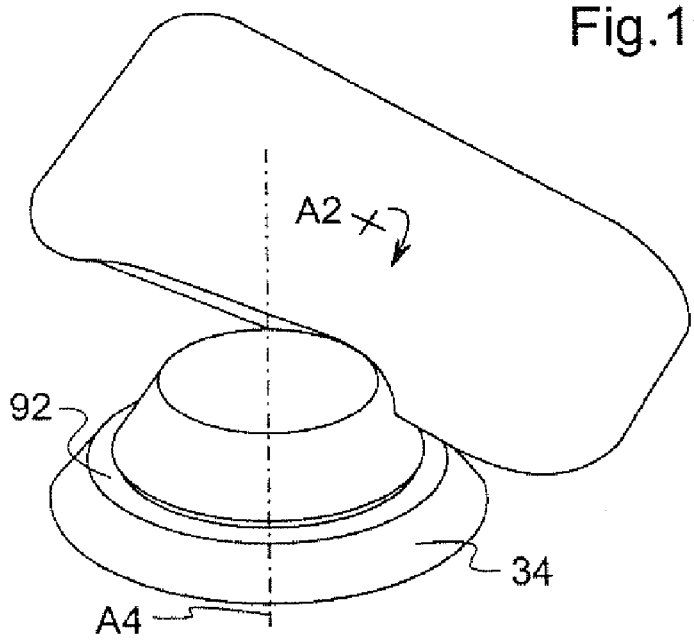
FIG. 10 is a perspective view of the working tool and of the ophthalmic lens while making a bevel portion on the edge face of the lens.

The machining of the portion 313 situated on the right temple side TD (see FIG. 8) is performed in similar manner. The tangent T2 at the point M4 to the curve of the portion 312 of the bevel to be made Forms an angle D2 with the plane P. By means of a second retraction ESC' of the finishing wheel 34 towards its position referenced 34' in FIG. 4, the axis of rotation A4 of the finishing wheel is transformed into an axis of rotation A4' of different orientation that makes it possible to use a working generator line 342. The angle formed by the working generator line 342 with the axis of rotation A2 makes it possible to obtain a bevel portion presenting a tangent to the curve at the point M4 that is inclined at substantially the angle D2 relative to the plane P, as desired. As shown in FIG. 10, and as described above, when the working portion of the beveling groove penetrates into the lens, said working portion extends around the bevel to be made with a certain amount of curvature that matches the curve desired for said portion 313 of the bevel (FIG. 8).

Throughout the control process, use is made of the freedom of the finishing wheel 34 to perform transfer movement TRA via the finishing module 25 in order to position the edge face 300 of the lens correctly relative to the finishing wheel 34, while simultaneously controlling the movement of the finishing wheel 34 in the retraction direction ESC and the movements of the lens 31 in the reproduction and rotation directions RES and ROT.

As mentioned above, the points of the edge face 300 of the lens are machined by continuously and dynamically controlling the lens and the finishing wheel in interdependent manner by using: the reproduction movement RES of the lens; the transfer movement TRA of the finishing wheel; the rotation movement ROT of the lens; and the retraction movement ESC of the finishing wheel.

Figure 9:
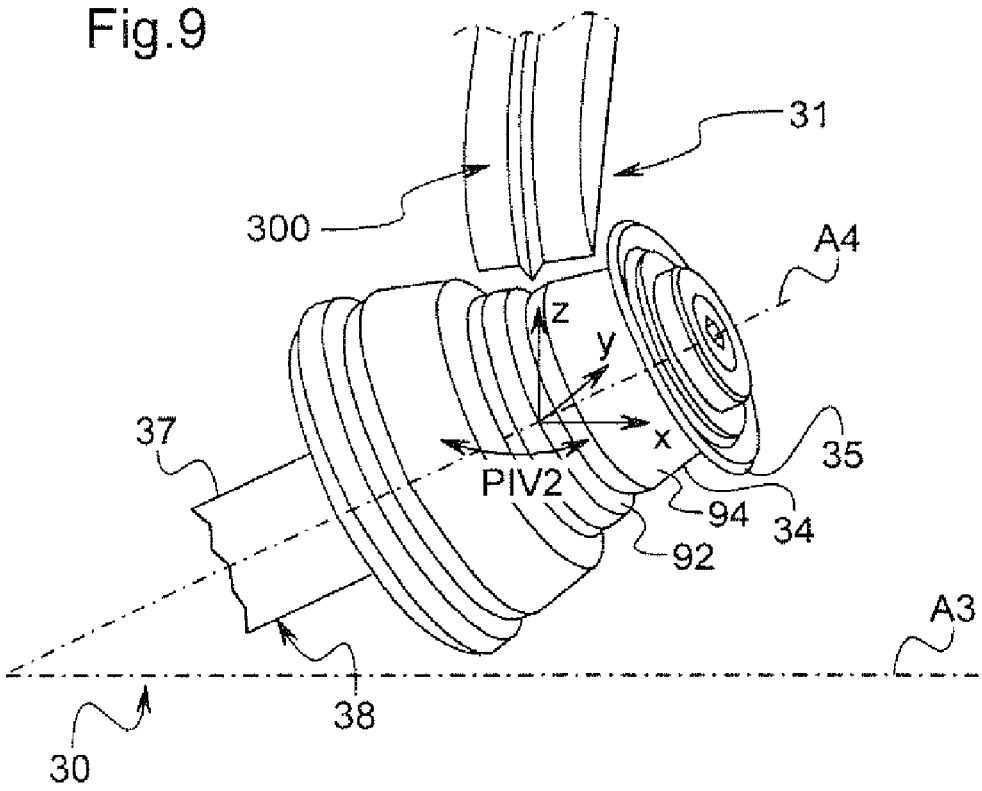
FIG. 9 is a perspective view of the working tool and the ophthalmic lens with the axis of rotation of the working tool being pivotally movable.

In a variant of the device and the method of the invention as shown in FIG. 9, provision can be made to use freedom to perform an additional pivoting movement PIV2 for moving and orientating the axis of rotation A4. This pivoting movement enables the axis of rotation A4 to be pivoted about an axis (in this variant, the Z axis) that lies in a plane extending transversely to the second axis of rotation A4 and substantially normal to the plane that is tangential to the portion of the edge face that is being machined.

The use of this additional pivoting movement PIV2 can optionally be combined with using the retraction movement about the axis A3 that enables the finishing tool to be retracted.

In addition, in order to finish the edge face 300 of the lens 31 correctly by using the finishing wheel 34, the frame of reference of the lens 31 is conserved between the roughing step and the finishing step so that the edge face 300 of the lens 31 for machining is indeed parallel to the working generator line of the finishing wheel 34. Between the roughing step and the finishing step, the lens 31 preferably remains clamped to the clamping and rotary drive shafts 12 and 13 without being unclamped or reclamped. Nevertheless, if provision is made for the lens 31 to be separated from and repositioned between the clamping shafts 12 and 13 of the grinder 10 during the edging operation, then a centering and drive pad is applied to the lens 31 prior to machining so as to give it a frame of reference that can be easily recovered, the pad being positioned with the lens 31 on the chucks 62, 63 of the clamping and rotary drive shafts 12 and 13 for the lens 31.

In a variant, it is possible to envisage using a finishing wheel as described above, but that is cylindrical. Instead of having a beveling groove, the finishing wheel may have a beveling chamfer.

Finally, instead of using a grindwheel or a cutter wheel, it is possible to make provision to use a working tool of the knife type, as proposed in the machines sold by National Optronics, Charlottesville, United States of America, and as described in U.S. Pat. No. 5,158,422.

FIGS. 11A, 11B, 11C, and 11D show a second embodiment of the invention. The shaper device in this second embodiment is modified as described below relative to the shaper device of the first embodiment as shown in FIGS. 1 to 10.

The axis A4 of the support 38 on which a cylindrical finishing wheel 341 is mounted is inclined relative to the axis of rotation A2 of the lens 31. In this embodiment, the axis A4 is inclined relative to the axis A2 substantially in the plane PR that contains the axis A2 and the reproduction direction RES, i.e. in the plane XZ' of the frame of reference shown in FIG. 3. This angle of inclination is not variable, and equal to about ten degrees.

In this second embodiment, the axis A4 of the finishing wheel 341 is movable in translation by means of an appropriate drive, in a plane P extending transversely to the axis A2.

The axis A4 of the finishing wheel 342 is moved dynamically in the plane P relative to the edge face 300 of the lens 31, or indeed relative to the first axis of rotation A2, as a function of the angle of rotation P of the lens 31 about said first axis of rotation A2, in such a manner, that for each portion of the edge face of the lens 31 that is being machined, the tangent to the curve of the working portion of the beveling groove is substantially parallel to the tangent of the curve of the bevel desired on said portion of the edge face.

Figure 11A:
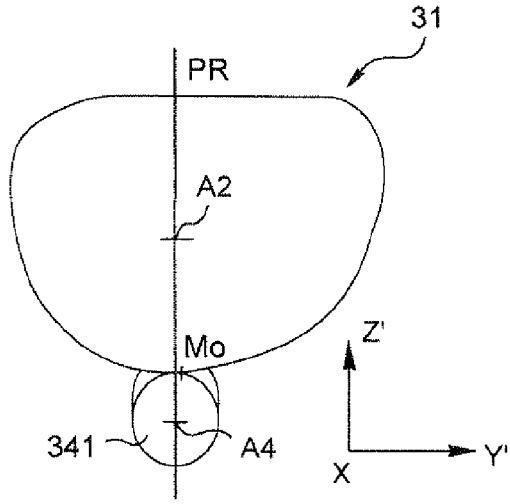
FIG. 11A is a face view of the ophthalmic lens and of the working tool while making a bevel portion with little camber on the edge face of the lens in a second embodiment.

In order to obtain the bevel portion 311, the axis A4 of the finishing wheel 341 is positioned by being moved in translation in the transverse plane P in such a manner that the axis A4 is situated in the plane PR containing the axis A2 and the reproduction direction RES (FIGS. 11A and 11).

Figure 11B:
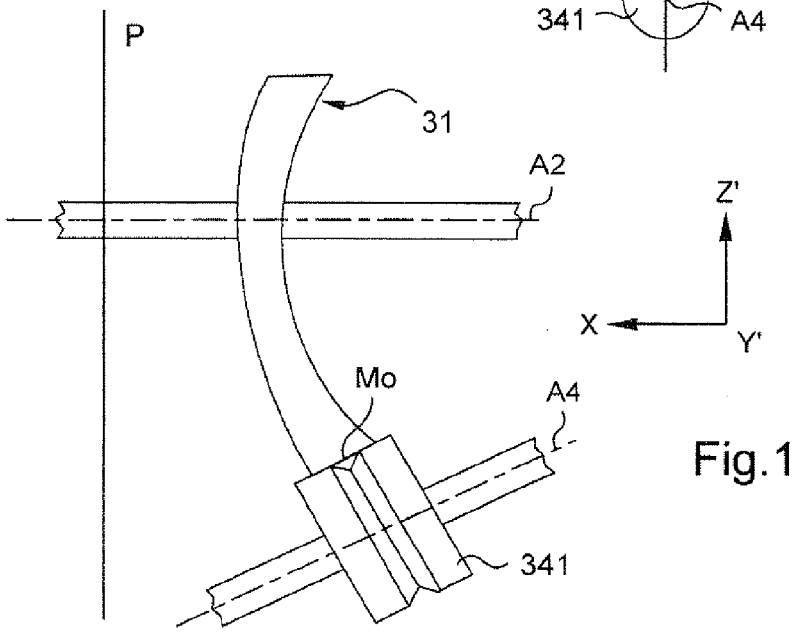
FIG. 11B is a side view of the ophthalmic lens and of the working tool of FIG. 11A.
Figure 11C:
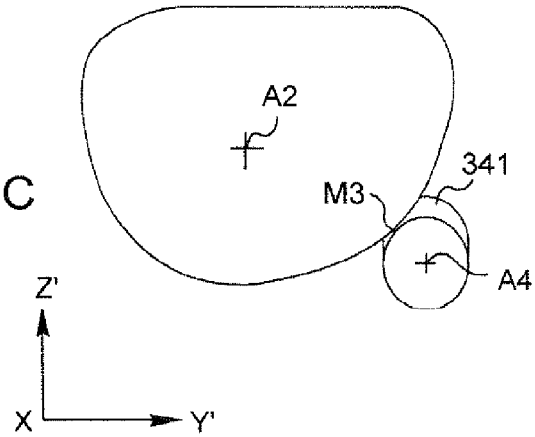
FIG. 11C is a face view of the ophthalmic lens and of the working tool of FIG. 11A, while making a cambered bevel portion on the edge of the lens in the second embodiment.
Figure 11D:
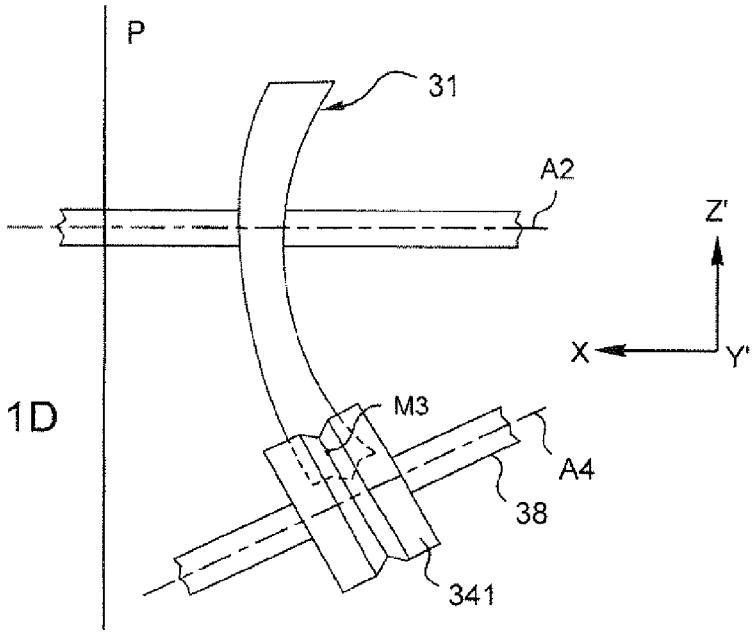
FIG. 11D is a side view of the ophthalmic lens and of the working tool of FIG. 11C.

To make the curves of the cambered portions 312 and 313 of the bevel, the finishing wheel 341 is offset in the plane P relative to the plane PR, as shown in FIGS. 11C and 11D so that the tangent to the working generator line of the beveling wheel is substantially parallel to the tangent to the curves of the portions 312 and 313 of the bevel that it is desired to obtain. It is then possible, e.g. for the portion 312, and as in the first embodiment shown in FIG. 5, to machine the edge face of the lens at the point M3 along the desired tangent to the curve of the bevel at this point (FIG. 1D).

The axis A4 of the finishing wheel 341 is moved mainly along the direction Y' in the transverse plane P, i.e. in a direction that extends transversely to the plane PR. The finishing wheel can also be moved along the direction Z', i.e. the direction perpendicular to the direction Y' in the transverse plane P, in order to put the working generator line of the finishing wheel into contact with the edge face of the lens at the portion of the edge face of the lens that is it desired to work. Alternatively, provision can be made to move the axis A4 of the finishing wheel 314 along the direction Y' and to make use solely of movement in the reproduction direction RES of the lens for establishing contact between the finishing wheel and the edge face of the lens that is to be worked.

Naturally, and as above, the movement of the axis A4 of the finishing wheel 341 in the plane P extending transversely to the axis A5 of the lens is controlled simultaneously with controlling the movement in the transverse direction TRA of the finishing wheel 341.

The finishing wheel 341 is cylindrical. In a variant, it is possible to make provision to use a conical wheel with a cone angle equal to the angle of inclination of the axis A4 relative to the axis A2 in the plane PR.

Figure 12:
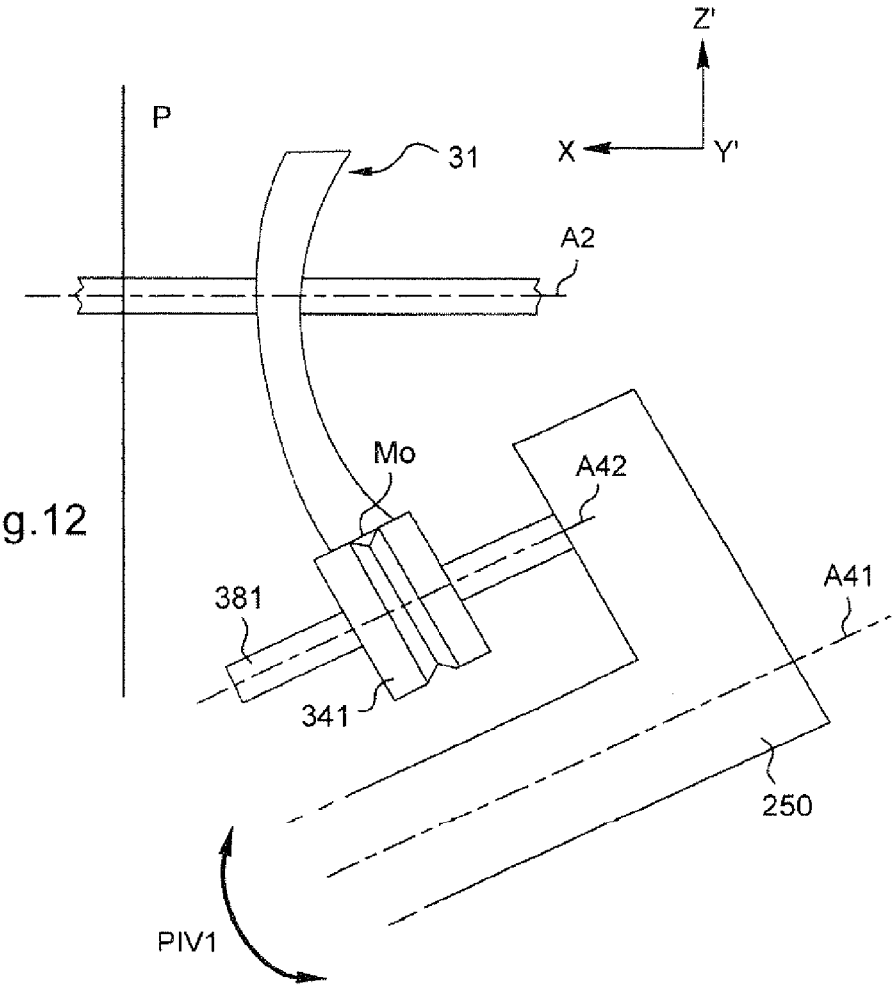
FIG. 12 is a side view of the ophthalmic lens and of the working tool while making a bevel portion with little camber on the edge face of the lens, in a third embodiment.

FIG. 12 shows a third embodiment constituting a variant of the second embodiment. As explained below, the shaper device in this third embodiment is modified relative to the second embodiment. Instead of using motor drive enabling the axis A4 of the finishing wheel 341 to be moved in the plane P extending transversely to the axis A2 as in the second embodiments the finishing wheel is mounted on a shaft 381 of axis A42 that is inclined in the plane P4 relative to the axis A2 by about ten degrees. The shaft 381 is secured to a pivot device 350 that is adapted to cause the shaft 381 of axis A42 to pivot about a pivot axis A42 parallel to the axis A42, the shaft 341 having the finishing wheel 341 mounted thereon.

The pivot axis A41 is preferably situated in the plane PR containing the axis A2 and the reproduction direction such that the axis A4 of the finishing wheel 34 can pivot symmetrically on either side of the axis A2 of the lens. The freedom of the finishing wheel 341 to move in pivoting is used together with its freedom to move in transfer along the axis A2 in order to position the working portion of the beveling groove and the portion of the edge face of the lens that is to be worked so that they place each other and, as before, so that the tangent to the curve of the working portion of the beveling groove is substantially parallel to the tangent of the curve of the bevel that is desired on said portion of the edge face.

The pivot device 250 is secured to the finishing module 25 and the axis A42 may coincide with the axis A4, and similarly the support 38 may constitute a portion of the pivot device 250. As in the second embodiment, the finishing wheel 341 is cylindrical in this embodiment, and in a variant it will be possible to make use of a conical grindwheel.

The invention claimed is:

1. A method of edging an ophthalmic lens (31), the method comprising:

turning the lens (31) about a first axis of rotation (A2) and working on an edge face of the lens (31) by one of a beveling grindwheel and a cutter (34; 341) provided with one of a beveling groove and a chamfer (92) and mounted to rotate about a second axis of rotation (A4; A42), wherein while machining the edge face (300) of the lens with one of the beveling grindwheel and the cutter (34), the second axis of rotation (A4; A42) and the first axis of rotation (A2) are moved dynamically relative to each other in at least one degree of freedom to adjust an orientation of a tangent to a curve of the working portion of one of the beveling groove and the chamfer (92) relative to the first axis (A2), this relative movement being controlled as a function of an angle of rotation (T) of the lens (31) about said first axis of rotation (A2), in such a manner that during machining of each portion of the edge face of the lens (31), said tangent remains parallel to the tangent (T1, T2, T3) to the curve of the bevel desired on said portion of the edge face (300).

2. The edging method according to claim 1, wherein the second axis (A4;

A42) of rotation is inclined relative to the first axis of rotation (A2) by a non-zero angle (K).

3. The edging method according to claim 2, wherein the angle (K) formed between the first and second axes of rotation (A2 and A4; A42) is about ten degrees.

4. The edging method according to claim 2, wherein the movement of the second axis of rotation (A42) is obtained by a first freedom of movement in pivoting (PIV1) about a first pivot axis (A41) parallel to the second axis of rotation (A42).

5. The edging method according to claim 2, wherein the movement of the second axis of rotation (A4) is obtained by freedom of movement in translation in a plane (P) extending transversely to the first axis of rotation (A2).

6. The edging method according to claim 5, wherein the axis of rotation (A2) of the lens (31) possesses freedom to move in a reproduction direction (RES) that extends substantially transversely to its axis of rotation (A2), and a direction of movement of the second axis of rotation (A4) of one of the beveling grindwheel and the cutter (341) extends transversely to said reproduction direction (RES).

7. The edging method according to claim 2, wherein the movement of the second axis of rotation (A4) is obtained by a second freedom to move in pivoting (ESC) about a retraction axis (A3) parallel to the first axis of rotation (A2).

8. The edging method according to claim 1, wherein the movement of the axis of rotation (A4) is obtained by a third freedom of movement (PIV2) about a second pivot axis (Z) situated in a plane extending transversely to the first axis of rotation (A2) and normal to the plane that is tangential to the portion of the edge face (300) that is being machined.

9. The edging method according to claim 2, wherein one of the beveling grindwheel and the cutter (34) presents a conical edging face (94) in addition to one of the beveling groove and the chamfer (92).

10. The edging method according to claim 9, wherein a cone angle of the edging face (94) of one of the beveling grindwheel and the cutter (34; 341) is equal to the angle (K) formed between the second axis of rotation (A4) and the first axis of rotation (A2).

11. The edging method according to claim 1, wherein one of the edging grindwheel and the cutter (34) possesses a maximum diameter of no more than 35 mm.

12. The edging method according to claim 1, wherein the step of working the edge face of the lens with one of the beveling grindwheel and the cutter (34; 341) is an edging finishing step, and provision is made prior to the edging finishing step for a step of roughing out the edging the edge face (300) of the lens (31) by an edging roughing grindwheel (50) mounted to rotate about a third axis of rotation (A3) parallel to the first axis (A2).

13. A shaper device (10) for edging an ophthalmic lens (31), the device comprising:

a support (12, 13) for the lens (31) mounted to turn about a first axis of rotation (A2), and one of a beveling grindwheel and a cutter (34; 341) for working the edge face (300) of the lens (31) and mounted to turn about a second axis of rotation (A4; A42), wherein said second axis of rotation (A4) possesses a controlled freedom of movement (ESC; PIV1; PIV2), and in that said device (10) includes a control unit programmed to control said movement (ESC; PIV1; PIV2), by performing the method of:

turning the lens (31) about the first axis of rotation (A2) and working on an edge face of the lens (31) by one of the beveling grindwheel and the cutter (34; 341) provided with one of a beveling groove and a chamfer (92) and mounted to rotate about the second axis of rotation (A4; A42), wherein while machining the edge face (300) of the lens with one of the beveling grindwheel and the cutter (34), the second axis of rotation (A4; A42) and the first axis of rotation (A2) are moved dynamically relative to each other in at least one degree of freedom to adjust an orientation of a tangent to a curve of the working portion of one of the beveling groove and the chamfer (92) relative to the first axis (A2), this relative movement being controlled as a function of an angle of rotation (T) of the lens (31) about said first axis of rotation (A2), in such a manner that during machining of each portion of the edge face of the lens (31), said tangent remains parallel to the tangent (T1, T2, T3) to the curve of the bevel desired on said portion of the edge face (300).

14. The edging method according to claim 3, wherein the movement of the second axis of rotation (A42) is obtained by a first freedom of movement in pivoting (PIV1) about a first pivot axis (A41) parallel to the second axis of rotation (A42).

15. The edging method according to claim 3, wherein the movement of the second axis of rotation (A4) is obtained by freedom of movement in translation in a plane (P) extending transversely to the first axis of rotation (A2).

16. The edging method according to claim 3, wherein the movement of the second axis of rotation (A4) is obtained by a second freedom to move in pivoting (ESC) about a retraction axis (A3) parallel to the first axis of rotation (A2).

17. The edging method according to claim 1, wherein one of the beveling grindwheel and the cutter (34) presents a conical edging face (94) in addition to one of the beveling groove and the chamfer (92).

* * * * *

UNITED STATES PATENT AND TRADEMARK OFFICE

CERTIFICATE OF CORRECTION

PATENT NO. : 8,167,680 B2
APPLICATION NO. : 12/094784
DATED : May 1, 2012
INVENTOR(S) : Michel Nauche It is certified that error appears in the above-identified patent and that said Letters Patent is hereby corrected as shown below:

In column 1, line 10, please amend "Lenses" to read -- lenses --

In column 1, line 35, please amend "lace" to read -- face --

In column 3, line 52, please amend "Interference" to read -- interference --

In column 6, line 29, please amend "mover" to read -- move --

In column 6, line 39, please amend "AC" to read -- A6 --

In column 7, line 20, please amend "shafts 1L2" to read -- shafts 12 --

In column 12, line 25, please amend "FIG. 11A and 11" to read -- FIG. 11A and 11B --

In column 12, line 35, please amend "FIG. 1D" to read -- FIG. 11D --

In column 12, line 51, please amend "A5" to read -- A2 --

In column 12, line 64, please insert a -- , -- after embodiments to read -- embodiments, --

In claim 2, at column 13, line 45, please delete the line break after "(A4" so the sentence reads -- (A4;A42) of rotation is inclined relative to the first axis of rotation (A2) by a non-zero angle (K) --

Signed and Sealed this
Third Day of July, 2012

David J. Kappos

David J. Kappos
*Director of the United States Patent and Trademark Office*